US006188749B1

(12) United States Patent
Schiller et al.

(10) Patent No.: US 6,188,749 B1
(45) Date of Patent: Feb. 13, 2001

(54) X-RAY EXAMINATION APPARATUS COMPRISING A FILTER

(75) Inventors: Christoph Schiller; Mark A. De Samber; Lambertus G. J. Fokkink, all of Eindhoven (NL)

(73) Assignee: U.S. Philips Corporation, New York, NY (US)

( * ) Notice: Under 35 U.S.C. 154(b), the term of this patent shall be extended for 0 days.

(21) Appl. No.: 09/236,239

(22) Filed: Jan. 22, 1999

(30) Foreign Application Priority Data

Jan. 23, 1998 (EP) ..... 98200179

(51) Int. Cl.[7] ..... G21K 3/00
(52) U.S. Cl. ..... 378/158; 378/156; 378/157
(58) Field of Search ..... 378/156, 157, 378/158

(56) References Cited

U.S. PATENT DOCUMENTS 4,335,327 * 6/1982 Waugh et al. ..... 378/129
4,856,042 * 8/1989 Staron et al. ..... 378/147
4,972,458 * 11/1990 Plewes ..... 378/146
5,559,853 * 9/1996 Linders et al. ..... 378/159
5,625,665 4/1997 Fokkink et al. ..... 378/156
5,666,396 9/1997 Linders et al. ..... 378/156
5,751,786 5/1998 Welters et al. ..... 378/156
5,768,340 6/1998 Geittner et al. ..... 378/159
5,966,426 * 10/1999 Marra et al. ..... 378/159
6,061,426 * 5/2000 Linders et al. ..... 378/149
6,118,855 * 9/2000 Welters et al. ..... 378/158

* cited by examiner

*Primary Examiner*—David P. Porta
*Assistant Examiner*—Allen C. Ho
(74) *Attorney, Agent, or Firm*—John F. Vodopia

(57) ABSTRACT

An X-ray examination apparatus (1), including an X-ray source (2) and an X-ray detector (5), is provided with an X-ray filter (6) which is arranged between the X-ray source and the X-ray detector. The X-ray filter (6) includes a plurality of filter elements (7) whose X-ray absorptivity can be adjusted by adjustment of a quantity of X-ray absorbing liquid (14) within the individual filter elements; a first end of individual filter elements communicates with the X-ray absorbing liquid whereas a second end communicates with an X-ray transparent liquid (12). The X-ray filter is preferably provided with a pressure control system for independent control of the liquid pressure in individual row ducts (11) and individual column ducts (13). Individual filter elements are preferably provided with a piston for separating the X-ray absorbing liquid from the X-ray transparent liquid.

7 Claims, 2 Drawing Sheets

X-RAY EXAMINATION APPARATUS COMPRISING A FILTER

BACKGROUND OF THE INVENTION

1. Field of the Invention

The invention relates to an X-ray examination apparatus which includes an X-ray source, an X-ray detector, and an X-ray filter which is arranged between the X-ray source and the X-ray detector, which X-ray filter includes a plurality of filter elements having an X-ray absorptivity which can be adjusted by controlling a quantity of X-ray absorbing liquid within the individual filter elements, where individual filter elements communicate with the X-ray absorbing liquid by way of a first end.

2. Description of Related Art

An X-ray examination apparatus of this kind is known from French patent application FR 2,599,886.

The known X-ray examination apparatus comprises an X-ray filter for limiting the dynamic range of an X-ray image, being the interval between the extremes of the brightness values. An X-ray image is formed on the X-ray detector by arranging an object, for example a patient to be examined, between the X-ray source and the X-ray detector and by irradiating said object by means of X-rays emitted by the X-ray source. If no precautions are taken, a large dynamic range of the X-ray image may occur. On the one hand, in some parts of the object, for example lung tissue, the X-ray transmissivity will be high whereas other parts of the object, for example bone tissue, can hardly be penetrated by X-rays. If no further precautions are taken, therefore, an X-ray image with a large dynamic range is obtained whereas, for example medically relevant information in the X-ray image is contained in brightness variations in a much smaller dynamic range; because it is not very well possible to make small details of low contrast suitably visible in a rendition of such an X-ray image, such an X-ray image is not very well suited for making a diagnosis. When the X-ray image is converted, using an image intensifier pick-up chain, into a light image which is picked up by means of a video camera, the dynamic range of the light image may be much greater than the range of brightness values that can be handled by the video camera without causing disturbances in the electronic image signal.

In order to limit the dynamic range of the X-ray image, the known X-ray examination apparatus includes an X-ray filter with filter elements provided with a bundle of parallel capillary tubes, each of which is connected, via a valve, to a reservoir containing an X-ray absorbing liquid which suitably wets the inner walls of the capillary tubes. In order to fill one of the capillary tubes with the X-ray absorbing liquid, the valve of the relevant capillary tube is opened after which the capillary tube is filled with the X-ray absorbing liquid by the capillary effect. Such a filled capillary tube has a high X-ray absorptivity for X-rays passing through such a filled capillary tube in a direction approximately parallel to its longitudinal direction. The valves are controlled so as to ensure that the amount of X-ray absorbing liquid in the capillary tubes is adjusted in such a manner that in parts of the X-ray beam which pass through parts of low absorptivity of the object filter elements are adjusted to a high X-ray absorptivity and that filter elements in parts of the X-ray beam which pass through parts of high absorptivity of the object, or are intercepted by a lead shutter, are adjusted to a low X-ray absorptivity.

In order to change the adjustment of the filter of the known X-ray examination apparatus it is first necessary to empty filled capillary tubes. Therefore, use is made of a paramagnetic X-ray absorbing liquid which is forced out of the capillary tubes by application of a magnetic field. After all capillary tubes have been emptied, the X-ray filter is adjusted anew by deactivation of the magnetic field and by subsequently opening valves of capillary tubes which are to be filled with the X-ray absorbing liquid for the new filter adjustment so as to adjust these tubes to a high X-ray absorptivity. Consequently, it is not very well possible to change the adjustment of the known X-ray filter within a brief period of time, for example one second. Therefore, the known X-ray apparatus is not suitable for forming successive X-ray images at a high image rate while changing the adjustment of the filter between the formation of successive X-ray images.

In order to control the quantity of X-ray absorbing liquid in the capillary tubes it is necessary that the period of time during which the valves are opened is accurately controlled; however, the mechanical drive of the valves, for example exhibiting inertia and play, impedes fast and accurate control of the quantity of X-ray absorbing liquid in the capillary tubes.

SUMMARY OF THE INVENTION

It is an object of the invention to provide an X-ray examination apparatus which includes an X-ray filter that can be adjusted more quickly than the known filter.

This object is achieved by means of an X-ray examination apparatus according to the invention which is characterized in that individual filter elements communicate with an X-ray transparent liquid by way of a second end.

Individual filter elements are partly filled with an X-ray absorbing liquid and their remainder is filled with an X-ray transparent liquid. In the context of the present patent application an X-ray absorbing liquid is to be understood to mean a liquid having a considerable X-ray absorptivity, for example a lead salt solution. In the context of the present application an X-ray transparent liquid is to be understood to mean a liquid which absorbs hardly any or no X-rays, for example oil. The amount of X-ray absorbing liquid in individual filter elements can be controlled hydropneumatically, i.e. on the basis of the liquid pressure in the X-ray absorbing and X-ray transparent liquids. Because only very few moving parts are required, only a very short period of time will be required so as to change the adjustment of the X-ray filter. Control of the amount of X-ray absorbing liquid on the basis of the liquid pressure also offers a faster response time in comparison with the known X-ray filter.

The filter elements are preferably arranged in a matrix. Individual filter elements are arranged at intersections of respective column ducts and row ducts. Row ducts and column ducts are liquid ducts in the row direction and the column direction, respectively. The row and column directions are different directions which usually extend substantially perpendicularly to one another. It will be evident that the terms row and column can be interchanged without affecting the operation of the X-ray filter. On the basis of the difference between the liquid pressure in the relevant column duct and the relevant row duct the relevant filter element is filled or not or is filled more or less with the X-ray absorbing liquid so that the X-ray absorptivity of the relevant filter element is adjusted on the basis of the liquid pressure. By choosing a given column duct and a given row duct so as to apply a predetermined, appropriate liquid pressure thereto, the filter element at the intersection of the relevant row duct and column duct is chosen and the amount of X-ray absorbing liquid therein is thus controlled.

Furthermore, it is advantageous to connect row and/or column ducts to the pressure control system by way of both ends. Consequently, only a slight pressure drop occurs in the ducts and the filter elements can be quickly and accurately adjusted to the desired X-ray absorptivity in a simple manner. It is also advantageous when the row and column ducts enclose an angle of approximately 60° relative to one another. The filter elements then constitute a hexagonal pattern with a dense packing. An X-ray filter comprising a large number of filter elements per unit of surface area can be realized notably by means of cylindrical filter elements having a round cross-section.

The pressure in row and/or column ducts can be controlled independently of one another by utilizing valves which are controlled by the pressure control system; in that case there will be hardly any mutual influencing between individual, for example neighboring filter elements. It is thus very well possible to form a spatial distribution of the X-ray absorption with variations over short distances by means of the X-ray filter, meaning that the X-ray filter has a high spatial resolution.

A number of valves is required which amounts to approximately the square root of the number of filter elements. Thus, even if an extremely large number of filter elements is used, for example in order to achieve a high spatial resolution, the number of valves required still remains reasonable. For example, an X-ray filter comprising tens of thousands of filter elements requires only a few hundreds of valves.

Preferably, the X-ray absorbing liquid is separated from the X-ray transparent liquid in the individual filter elements by pistons. The pistons counteract mixing of the X-ray transparent liquid and the X-ray absorbing liquid. Therefore, the miscibility of these liquids need not be extremely small. Furthermore, such a piston isolates the relevant filter element from the row ducts or from the column ducts when the filter element has been completely filled with one of the liquids. Due to the friction between the piston and the wall of the filter element, the adjustment of the X-ray filter is maintained and it will not be necessary to apply a liquid pressure continuously. For the design of the X-ray filter the fact is taken into account that the liquid pressure can overcome the friction between the piston and the wall of the filter element.

Preferably, a coating layer is provided notably on the parts of the system which face the wall of the relevant filter element in the X-ray filter. As a result of the use of the coating layer it is achieved that no liquid can leak between the wall and the piston. Notably aluminium oxide ($Al_2O_3$) and polyimide are suitable materials for forming such a coating layer.

A high spatial resolution is achieved by means of small filter elements, preferably filter elements having a cross-section which is less than approximately 5 mm.

By using an X-ray absorbing liquid and an X-ray transparent liquid which do not mix or only hardly so, mixing of the two liquids is avoided in a natural manner so that less severe requirements may be imposed as regards the sealing action of the piston. It may even be possible to dispense with the pistons.

BRIEF DESCRIPTION OF THE DRAWING

These and other aspects of the invention will be apparent from and elucidated with reference to the embodiments to be described hereinafter with reference to the accompanying drawing; therein.

DETAILED DESCRIPTION OF THE PREFERRED EMBODIMENT

Figure 1:
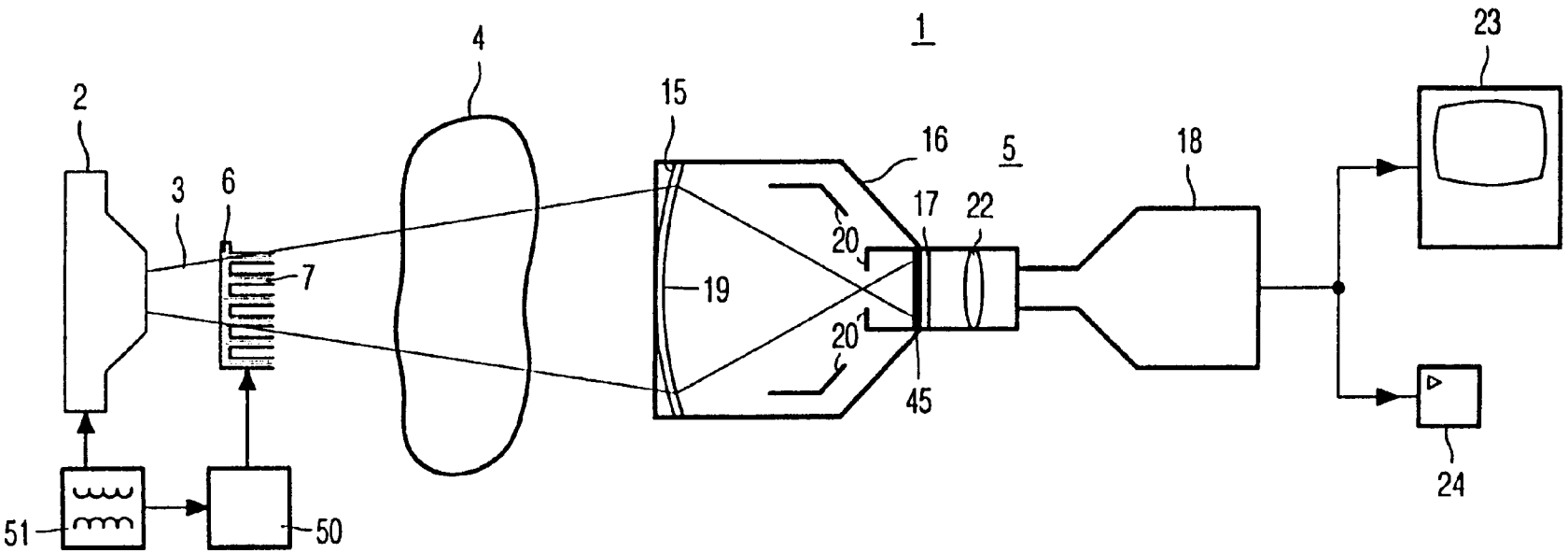
FIG. 1 shows diagrammatically an X-ray examination apparatus 1 according to the invention.

FIG. 1 shows diagrammatically an X-ray examination apparatus 1 according to the invention. The X-ray source 2 emits an X-ray beam 3 in order to irradiate an object 4. As a result of differences in the X-ray absorption in the object 4, for example a patient to be radiologically examined, an X-ray image is formed on an X-ray-sensitive surface 15 of the X-ray detector 5 which is arranged opposite the X-ray source. A highvoltage power supply unit 51 supplies the X-ray source 2 with an electric high voltage. The X-ray detector 5 of the present embodiment is an image intensifier pick-up chain which includes an X-ray image intensifier 16 for converting the X-ray image into a light image on an exit window 17, and also includes a video camera 18 for picking up the light image. The entrance screen 19 acts as an X-ray-sensitive surface of the X-ray image intensifier which converts incident X-rays into an electron beam which is imaged onto the exit window by means of an electron optical system 20. The incident electrons generate the light image on a phosphor layer 45 of the exit window 17. The video camera 18 is coupled to the X-ray image intensifier 16 by means of an optical coupling 22, for example a lens system or an optical fiber coupling. The video camera 18 derives an electronic image signal from the light image, said image signal being applied to a monitor 23 in order to visualize image information in the X-ray image. The electronic image signal may also be applied to an image processing unit 24 for further processing.

Between the X-ray source 2 and the object 4 there is arranged the X-ray filter 6 for local attenuation of the X-ray beam. The X-ray absorptivity of individual filter elements 7 of the X-ray filter 6 is adjusted by means of an adjusting unit 50. The adjusting unit 50 is coupled to the high-voltage power supply unit 51 so that the X-ray filter 6 can be adjusted on the basis of the intensity of the X-ray beam 3 emitted by the X-ray source.

Figure 2:
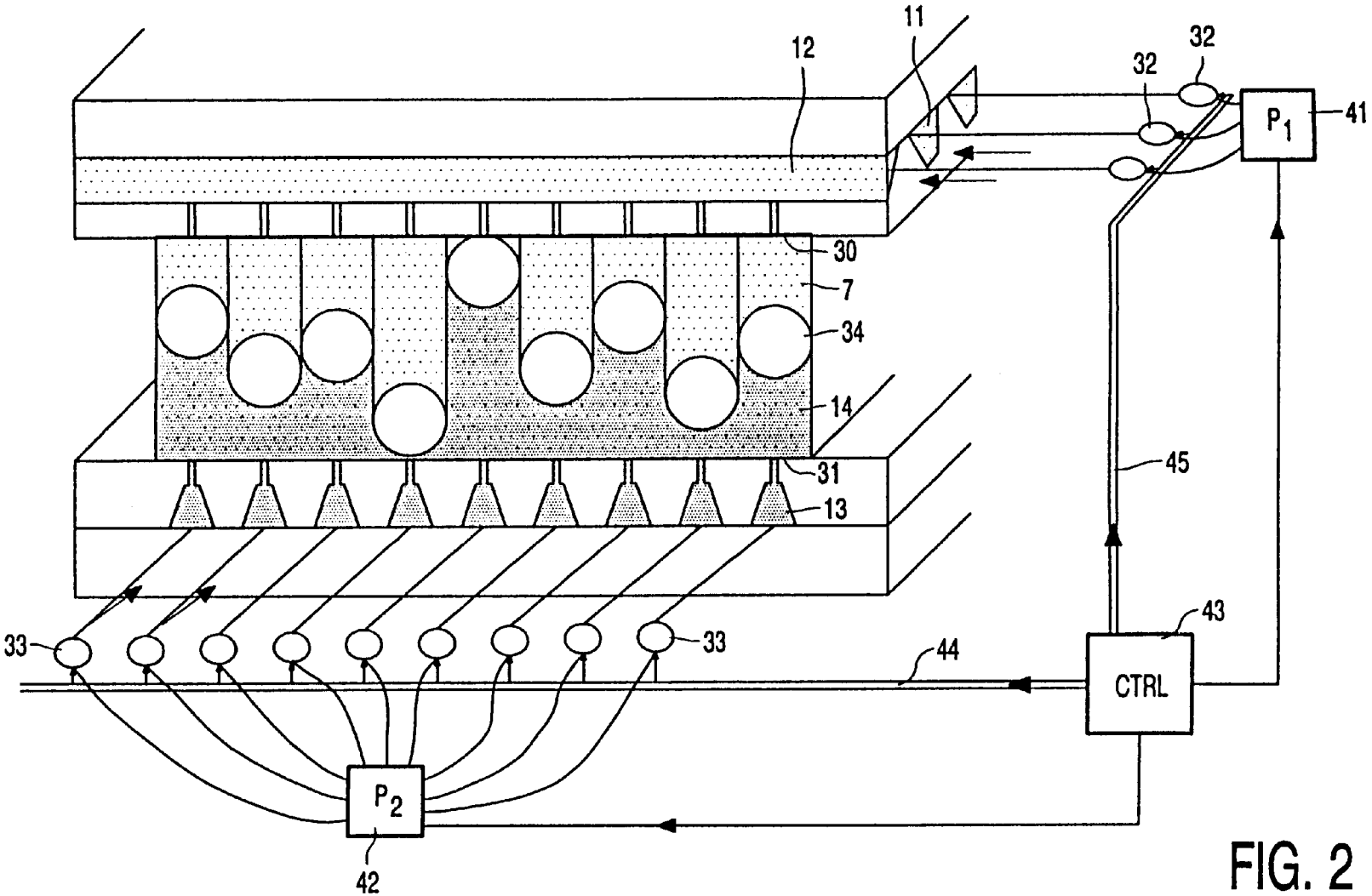
FIG. 2 is a diagrammatic representation of the X-ray filter of the X-ray examination apparatus according to the invention.

FIG. 2 is a diagrammatic representation of the X-ray filter of the X-ray examination apparatus according to the invention. The X-ray filter includes a system of approximately parallel row ducts 11 which are filled with an X-ray transparent liquid 12. The X-ray filter also includes a system of approximately parallel column ducts 13 which are filled with an X-ray absorbing liquid 14. The row ducts extend approximately perpendicularly to the column ducts in the example shown. A suitable X-ray absorbing liquid is, for example a solution of a lead salt, for example lead nitrate, lead dithionate or lead perchlorate in demineralized water, or liquid mercury. A suitable X-ray transparent liquid is, for example an oil which mixes only poorly with water. The filter elements 7 in the form of capillary tubes are provided between the row ducts 11 and the column ducts 13 in such a manner that each time a filter element is connected to a row duct 11 by way of an end 30 and to a column duct 13 by way of its other end 31. More specifically, an individual capillary tube is connected, by way of a first valve 32 and via the relevant row duct 11, to a first pump 41 and, by way of a second valve 33 and the relevant column duct 13, to a second pump 42. Each of the capillary tubes is provided with a piston 34 which keeps the X-ray absorbing liquid separated from the X-ray transparent liquid. The capillary tubes have a cross-section with a dimension of approximately 1 mm. The pistons in the example shown in FIG. 2 are formed by small balls, but other bodies can also be used as pistons. The pistons accurately fit in the relevant capillary tubes so that leakage of X-ray transparent and X-ray absorbing liquid between the piston and the wall of the capillary is avoided. The pistons are made, for example of an X-ray transparent material such as glass, anorganic oxides such as aluminium oxide ($Al_2O_3$) and silicon dioxide $SiO_2$ or polymers such as polycarbonate. In order to achieve suitable sealing for the liquids and/or a suitable degree of friction, it is advantageous to provide the pistons with a coating layer of, for example aluminium oxide ($Al_2O_3$) or polyimide. The row ducts 11 and the column ducts are connected to a pressure control system. The pressure control system includes the first pump 41, the row valves 32, via which the first pump 41 is connected to the individual row ducts 11, and the column valves 33, via which the second pump 42 is connected to the individual column ducts 13. Preferably, electronically controllable row and column valves are used. The pumps 41, 42 and the row and column valves 31, 32 are controlled by means of a control unit 43. To this end, the control unit 43 is connected, via bus connections 44, 45, to control inputs of the row and column valves. Furthermore, the control unit is connected to control inputs of the pumps 41 and 42. It is to be noted, however, that use can be made of a single pump instead of two separate pumps, but in that case the control unit 43 must ensure that the row valves 32 are closed when only the column ducts 13 are to be pressurized, and that the column valves 33 are closed when only the row ducts 11 are to be pressurized. The X-ray absorbing liquid and the X-ray transparent liquid in the individual row and column ducts can be pressurized by means of the pump(s), the control unit 43 and the row and column valves. The amount of X-ray absorbing liquid in the capillary tubes can be adjusted on the basis of the liquid pressure in the row and column ducts whereto the relevant capillary tube is connected. The pumps 41, 42 and the control unit 43 form part of the adjusting unit 50. Only a small amount of time is required to open the valves and to displace the pistons under the influence of the liquid pressure so as to adjust the X-ray filter. It has been found that the X-ray filter can be adjusted within 40–50 ms, or even within 10 ms, depending on the liquid pressure. The adjustment of the X-ray filter can be readily canceled by opening all valves of the ducts containing the X-ray transparent liquid, being the row ducts 11 in the example shown in FIG. 2.

The capillary tubes extend approximately parallel to the X-ray beam. Using a 5 molar lead salt solution and capillary tubes having a length of from approximately 5 to 6 mm, a 100-fold attenuation of the X-ray beam can be achieved and the X-ray absorption of individual capillary tubes may deviate by a factor of 20.

Cylindrical pistons can also be used instead of balls. Such cylindrical pistons offer slightly more friction with respect to the wall of the capillary tubes. Because of this friction, the pistons can remain in their respective positions until liquid pressure is applied.

The row and column ducts can be comparatively simply formed in a plate of glass, quartz, silicon or a polymer by chemical etching.

All references cited herein are incorporated herein, as well as the priority document European Patent Application 98200179.4 filed Jan. 23, 1998, by reference in their entirety and for all purposes to the same extent as if each individual publication or patent or patent application was specifically and individually indicated to be incorporated by reference in its entirety for all purposes.

What is claimed is:

1. An X-ray examination apparatus comprising:

an X-ray source, an X-ray detector, and an X-ray filter which is arranged between the X-ray source and the X-ray detector, wherein the X-ray filter comprises a plurality of filter elements having an X-ray absorptivity which can be adjusted by controlling a quantity of X-ray absorbing liquid within the individual filter elements in a matrix arrangement of rows and columns, which filter elements communicate with the X-ray absorbing liquid by way of a first end an X-ray transparent liquid by way of a second end; and wherein the filter elements communicate per row with a row duct, containing an X-ray absorbing liquid, by way of their first ends, the filter elements communicate per column with a column duct, containing an X-ray transparent liquid, by way of their second ends, and the X-ray filter is provided with a pressure control system for adjusting the liquid pressure independently in individual row ducts and individual column ducts.

2. An X-ray examination apparatus as claimed in claim 1, wherein individual filter elements are formed by cylinders having a cross-section of a diameter smaller than 5 mm.

3. An X-ray examination apparatus as claimed in claim 1, wherein individual row ducts and individual column ducts are provided with respective valves, and the pressure control system is arranged to control the valves.

4. An X-ray examination apparatus as claimed in claim 1, wherein individual filter elements are provided with a piston for separating the X-ray absorbing liquid from the X-ray transparent liquid.

5. An examination apparatus as claimed in claim 4, wherein the piston is provided with a coating layer.

6. An X-ray examination apparatus as claimed in claim 1, wherein the X-ray absorbing liquid and the X-ray transparent liquid are not miscible.

7. The apparatus of claim 6 wherein the X-ray absorbing liquid comprises an aqueous solution and the X-ray transparent liquid comprises an oil.

* * * * *